US006745485B2

(12) United States Patent
Shor

(10) Patent No.: US 6,745,485 B2
(45) **Date of Patent: *Jun. 8, 2004**

(54) CHALK LINE DEVICE

(76) Inventor: Ron Shor, 4523 W. 172nd St., Lawndale, CA (US) 90260

( * ) Notice: Subject to any disclaimer, the term of this patent is extended or adjusted under 35 U.S.C. 154(b) by 0 days.

This patent is subject to a terminal disclaimer.

(21) Appl. No.: 10/223,124

(22) Filed: Aug. 19, 2002

(65) Prior Publication Data

US 2002/0194744 A1 Dec. 26, 2002

Related U.S. Application Data

(63) Continuation-in-part of application No. 09/636,612, filed on Aug. 11, 2000, now Pat. No. 6,434,843, which is a continuation-in-part of application No. 09/276,109, filed on Mar. 25, 1999, now Pat. No. 6,167,632.

(51) Int. Cl.[7] ..... B44D 3/38

(52) U.S. Cl. ..... 33/414; 33/413; 33/393

(58) Field of Search ..... 33/414, 413, 755, 33/756, 760, 392, 393, 761, 764, 769, 768

(56) References Cited

U.S. PATENT DOCUMENTS

| | | | | | |
|---|---|---|---|---|---|
| 267,655 | A | * | 11/1882 | Vajen | 33/392 |
| 485,376 | A | * | 11/1892 | Fuller | 33/392 |
| 630,262 | A | * | 8/1899 | Nacke | 33/392 |
| 680,557 | A | * | 8/1901 | Wilson | 33/414 |
| 921,302 | A | | 5/1909 | Starr | |
| 947,892 | A | * | 2/1910 | Eastman | 33/414 |
| 997,803 | A | | 7/1911 | Giffin | |
| 1,596,882 | A | * | 8/1926 | Langsner | 33/392 |
| 2,589,500 | A | | 3/1952 | Landon et al. | |
| 3,046,663 | A | | 7/1962 | Romero | |
| 3,078,581 | A | | 2/1963 | Foster | |
| 3,113,387 | A | * | 12/1963 | Bean, Jr. | 33/392 |
| 3,126,637 | A | | 3/1964 | Short | |
| 3,191,308 | A | | 6/1965 | Lindenau | |
| 3,206,855 | A | | 9/1965 | Fletcher | |
| 3,888,010 | A | * | 6/1975 | Hyde et al. | 33/414 |
| 3,897,023 | A | * | 7/1975 | Couch et al. | 242/100.1 |
| 4,192,078 | A | * | 3/1980 | Lore et al. | 33/414 |
| 4,461,091 | A | * | 7/1984 | Gammon | 33/392 |
| 4,660,291 | A | | 4/1987 | Dehn | |
| 5,063,681 | A | | 11/1991 | Bradley | |
| 5,212,875 | A | | 5/1993 | Corso | |
| D339,044 | S | | 9/1993 | Kennedy | |
| D345,513 | S | * | 3/1994 | Syrett | 33/414 |
| 5,444,919 | A | * | 8/1995 | Alves | 33/414 |
| 5,465,494 | A | * | 11/1995 | Johnston | 33/414 |
| 5,509,616 | A | * | 4/1996 | Millen, Jr. et al. | 33/414 |
| 5,683,055 | A | * | 11/1997 | Dufour | 33/414 |
| 5,727,324 | A | * | 3/1998 | Moore | 33/414 |
| 5,920,997 | A | * | 7/1999 | Girtman | 33/414 |
| D445,701 | S | | 7/2001 | Hutchings | |
| 6,289,597 | B1 | * | 9/2001 | Beyers | 33/414 |

* cited by examiner

*Primary Examiner*—Diego Gutierrez
*Assistant Examiner*—Mirellys Jagan
(74) *Attorney, Agent, or Firm*—Leonard & Proehl, Prof. L.L.C.

(57) ABSTRACT

A chalk line device for marking straight lines in construction applications. The chalk line device includes a housing with a pair of separable sections and a pair of openings. Each of the sections has a sidewall, a pair of opposite ends, and a pair of side edges extending between the ends. A divider panel may optionally be positioned between the sections of the housing to separate the housing into a pair of compartments. A first spool may be rotatably disposed in one compartment, and a second spool may be disposed in the other compartment. In one optional embodiment, a single spool, is located in the housing and an endcap with a pointed tip is mounted in the cap. The pointed tip may be retractable.

13 Claims, 9 Drawing Sheets

CHALK LINE DEVICE

REFERENCE TO RELATED APPLICATION

This application is a continuation-in-part of application Ser. No. 09/636,612, filed. Aug. 11, 2000, now U.S. Pat. No. 6,434,843 which is a continuation-in-part of application Ser. No. 09/276,109, filed Mar. 25, 1999, now U.S. Pat. No. 6,167,632.

BACKGROUND OF THE INVENTION

1. Field of the Invention

The present invention relates to chalk line boxes and more particularly pertains to a new chalk line device for marking straight lines in construction applications.

2. Description of the Prior Art

The use of chalk line boxes is known in the prior art. More specifically, chalk line boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,126,637; 2,589,500; 5,212,875; 5,063,681; 4,660,291; and U.S. Pat. No. Des. 339,044.

While these devices fulfill their respective, particular objectives and requirements, the aforementioned patents do not disclose a new chalk line device. The inventive device includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

In these respects, the chalk line device according to the present invention substantially departs from the conventional concepts and designs of the prior art, and in so doing provides an apparatus primarily developed for the purpose of marking straight lines in construction applications.

SUMMARY OF THE INVENTION

In view of the foregoing disadvantages inherent in the known types of chalk line boxes now present in the prior art, the present invention provides a new chalk line device construction wherein the same can be utilized for marking straight lines in construction applications.

The general purpose of the present invention, which will be described subsequently in greater detail, is to provide a new chalk line device apparatus and method which has many of the advantages of the chalk line boxes mentioned heretofore and many novel features that result in a new chalk line device which is not anticipated, rendered obvious, suggested, or even implied by any of the prior art chalk line boxes, either alone or in any combination thereof.

To attain this, the present invention generally comprises a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chalk line device apparatus and method which has many of the advantages of the chalk line boxes mentioned heretofore and many novel features that result in a new chalk line device which is not anticipated, rendered obvious, suggested, or even implied by any of the prior art chalk line boxes, either alone or in any combination thereof.

It is another object of the present invention to provide a new chalk line device which may be easily and efficiently manufactured and marketed.

It is a further object of the present invention to provide a new chalk line device which is of a durable and reliable construction.

An even further object of the present invention is to provide a new chalk line device which is susceptible of a low cost of manufacture with regard to both materials and labor, and which accordingly is then susceptible of low prices of sale to the consuming public, thereby making such chalk line device economically available to the buying public.

Still yet another object of the present invention is to provide a new chalk line device which provides in the apparatuses and methods of the prior art some of the advantages thereof, while simultaneously overcoming some of the disadvantages normally associated therewith.

Still another object of the present invention is to provide a new chalk line device for marking straight lines in construction applications.

Yet another object of the present invention is to provide a new chalk line device which includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

Still yet another object of the present invention is to provide a new chalk line device that features two different colors of chalk in the separate chambers. This permits a user to redo a bad snap by using the other color. This is particularly useful when the two lines are very close together.

Even still another object of the present invention is to provide a new chalk line device that eliminates the need to carry two chalk line boxes, one with a plumb bob to do vertical lines, and another with a hook to do diagonal lines. Rather, a hook may be attached to one line and a plumb bob to the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
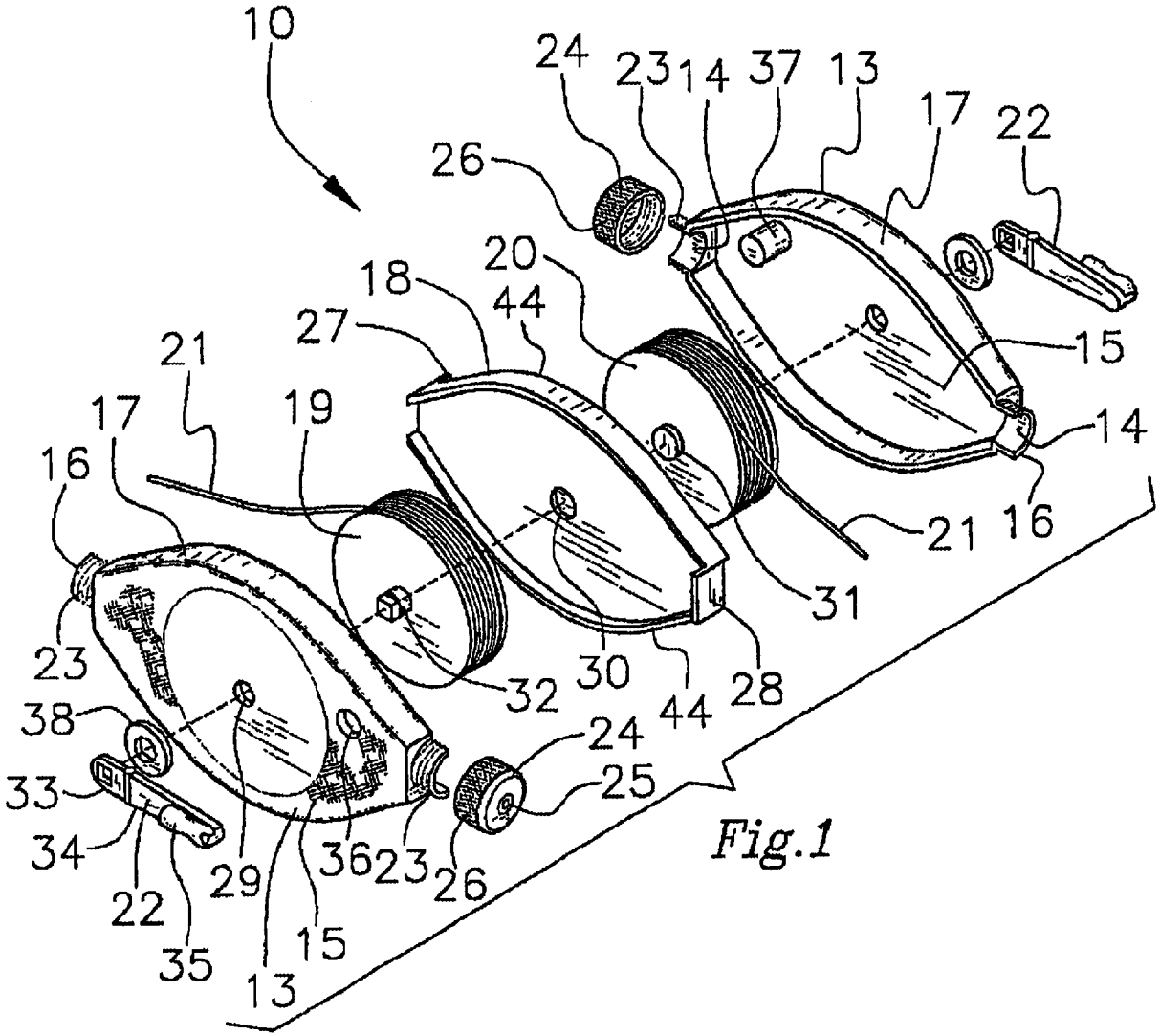
FIG. 1 is a schematic perspective exploded view of a new chalk line device according to the present invention.

With reference now to the drawings, and in particular to FIGS. 1 through 11 thereof, a new chalk line device embodying the principles and concepts of the present invention and generally designated by the reference numeral 10 will be described.

Figure 2:
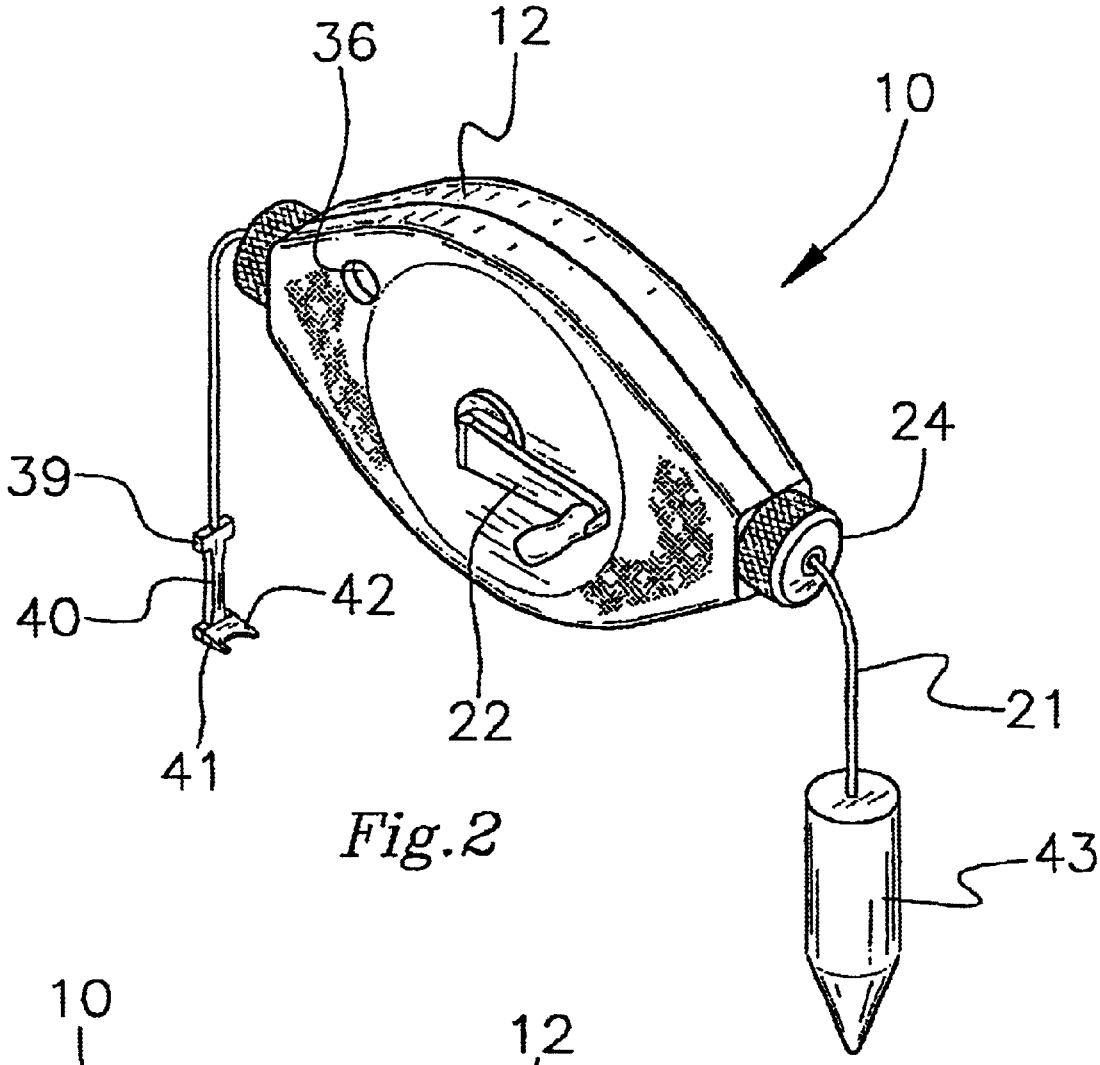
FIG. 2 is a schematic perspective view of the present invention.
Figure 3:
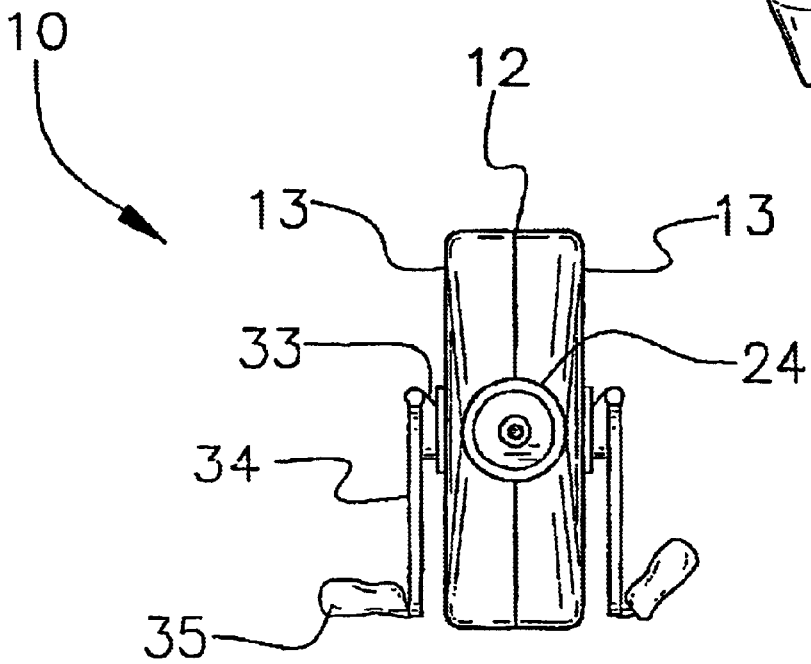
FIG. 3 is a schematic side view of the present invention.

As best illustrated in FIGS. 1 through 3, the chalk line device 10 generally comprises a housing 12 with a pair of separable sections 13 and a pair of openings 14. Each of the sections has a sidewall 15, a pair of opposite ends 16, and a pair of side edges 17 extending between the ends. The side edges of the sections may define a perimeter wall. In one embodiment of the invention, a divider panel 18 may be positioned between the sections of the housing to separate the housing into a pair of compartments.

A first spool 19 is rotatably disposed in the housing, and in the embodiments of the invention wherein more than one compartment is defined, the first spool may be positioned in one of the compartments of the housing. A second spool 20 may also be rotatably disposed in the housing, such as in another one of the compartments of the housing. Each of the spools has a quantity of line 21 wrapped therearound. A handle 22 may be mounted on each of the spools and positioned outside the housing. The handle permits external rotation of the spool to which it is connected.

Preferably, the pair of side edges of the sections taper together towards the ends such that each of the sections has a generally oblong football-like shape.

Also preferably, each of the ends of each of the sections has an externally threaded semicircular portion 23 extending or protruding from it. The semicircular portions of one of the sections engage the semicircular portions of another of the sections to form a pair of openings into the housing. In such an embodiment, a pair of caps or endcaps 24 are threadedly coupled to the openings of the housing. Each of the endcaps may have an eyelet 25 extending through it through which the line may extend. Optionally, each of the endcaps may have alternating diagonal scoring 26 or knurling therearound for frictionally enhancing the grip of a user when removing the endcaps.

Significantly, the caps 24 removably mounted on the housing function to selectively closing the openings in the housing. A first one of the caps engages a first one of the protruding semicircular portions of each of the first and second sections 13 at the first opening, and a second one of the caps engages a second one of the protruding semicircular portions of the first and second sections at the second opening. The caps also function to releasably secure the first and second sections 13 of the housing together such that mounting of the first and second caps on the housing holds the first and second sections together, and removal of the caps from the housing releases the first and second sections from each. The first protruding circular portions of the first and second sections may form a first tubular structure with a substantially cylindrical exterior surface, and the exterior surface of the first tubular structure may have threads formed thereon so that the first cap is threadable onto the first tubular structure to hold the first protruding portions together and thereby secure the first and second sections together. Similarly, the second protruding portions of the first and second sections may form a second tubular structure with a substantially cylindrical exterior surface, and the exterior surface of the second tubular structure may have threads formed thereon so that the second cap is threadable onto the second tubular structure to hold the second protruding portions together and thereby secure the first and second sections together.

Preferably, the divider panel forms a seal with the housing for helping prevent materials such as chalk from traveling between the compartments. Ideally, a peripheral flange 44 extends around the outer periphery of the divider panel to form a seal with the housing to better prevent chalk from escaping from the housing and intermingling from one compartment to another. The peripheral flange should be oriented perpendicular to the divider panel and extend out past both faces of the divider panel.

Also preferably, the divider panel has a first flange 27 extending from an end of the divider panel in a first direction for closing one of the openings off from one of the compartments. The divider panel also has a second flange 28 extending from another end of the divider panel in a second direction for closing another of the openings off from another of the compartments.

Each of the spools has a quantity of line wrapped around it, The line of one of the spools is slidably extendible out of one of the openings of the housing and through the eyelet of one of the endcaps. The line of another of the spools is slidably extendible out of another of the openings of the housing and through the eyelet of the other endcap.

Preferably, each of the sections of the housing has a central aperture 29 through its sidewall. Each of the spools also has a crankshaft 32. The crankshafts extend through the central apertures of the sections of the housings. The divider panel also has opposed central cavities 30 extending towards each other. Each of the spools has an inner protuberance 31 that is rotatably inserted in an associated central cavity of said divider panel. The inner protuberances should be bulbous so that they snap into the central cavities.

Preferably, the pair of handles are mounted to the crankshafts of the spools. The handles permit external rotation of the spools. In one embodiment, each of the handles has a hinge portion 33 that is coupled to a crankshaft, an arm portion 34 pivotally coupled to the hinge portion, and a grasping portion 35 rotatably coupled to the arm portion.

In such an embodiment, each of the sidewalls of the sections of the housing has a handle receiving aperture 36 extending therein and a tubular casing 37 extending into the housing from the handle receiving aperture. The casings are adapted for preventing chalk dust from contacting the grasping portions when inserted in the handle receiving apertures.

The hinge portion permits pivoting of the arm portion between a deployed position and a retracted position. The grasping portion is outwardly extendable when the arm portion is in a deployed position. The grasping portion is inserted in the handle receiving aperture of the housing when the arm portion is in a retracted position.

In a second embodiment, or in combination with the first embodiment, each of the grasping portions is pivotable between a folded position and an unfolded position. As shown in FIG. 1, each of the grasping portions is aligned generally parallel the respective arm portion when in the folded position. As shown in FIGS. 2 and 3, each of the grasping portions is aligned generally perpendicular the respective arm portion when in the unfolded position.

A pair of washers 38 may extend around the crankshafts of the spools between the handles and the housing for helping prevent wear on the housing.

As seen in FIG. 2, a hook 39 may be coupled to a free end of the line of one of the spools. In such an embodiment, the hook has an I-shaped portion 40 coupled to the line and a U-shaped portion 41 extending perpendicularly from an outer end of the I shaped portion and adapted for hooking onto corners of building materials. Ideally, the U-shaped portion has a pair of teeth 42 extending from it that are adapted for biting into the corners of building materials to prevent the hook from slipping off of the corners.

Optionally, a plumb bob 43 may be coupled to a free end of the line of another of the spools. Having both a hook and a plumb bob on the device reduces the quantity of tools a user needs to carry with him or her as the device functions as two separate tools.

Preferably, a quantity of chalk powder of a first color is disposed in one of the compartments of the housing. A quantity of chalk powder of a unique second color is disposed in another of the compartments of the housing.

The preferred length of the device between its opposite ends (including the endcaps) is between about 4 and 6 inches, ideally about 5½ inches. The preferred width of the device between the sidewalls of the sections of the housing (not including the handles) is between about 1½ and 2 inches, ideally about 1¾ inches.

In use, the line from one of the spools is extended from the housing and stretched tight between two points. The line is then pulled and released so that it "snaps" against a surface, leaving a line of chalk dust. When finished using, the handle is rotated to reel in the line.

Because the two lines are completely independent of each other, users would be able to continue their work if one of the chalk lines was severed or was caught in the housing, or if one compartment ran low on chalk dust.

Figure 4:
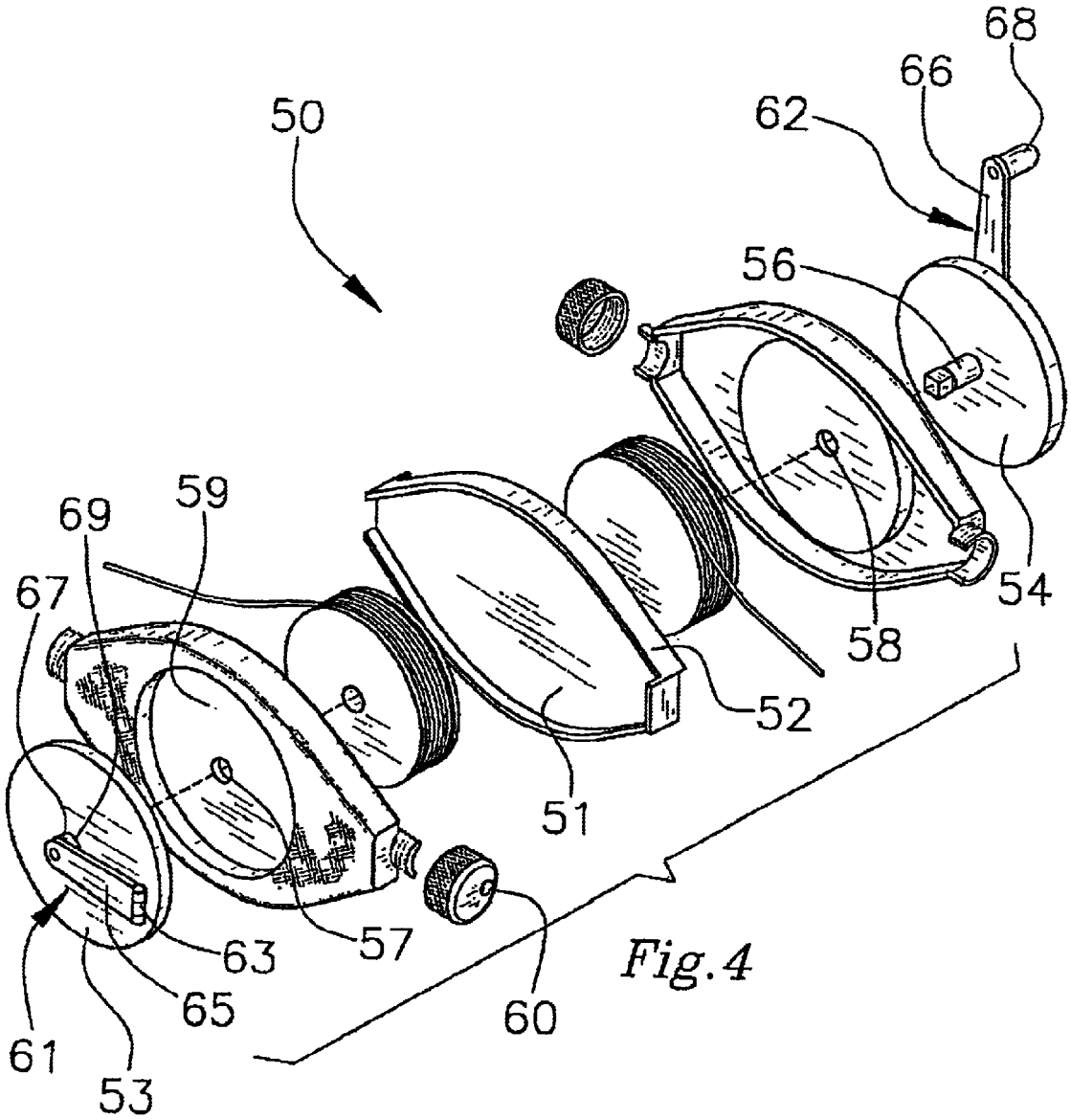
FIG. 4 is a schematic exploded view of an optional embodiment of the chalk line device according to the present invention.
Figure 5:
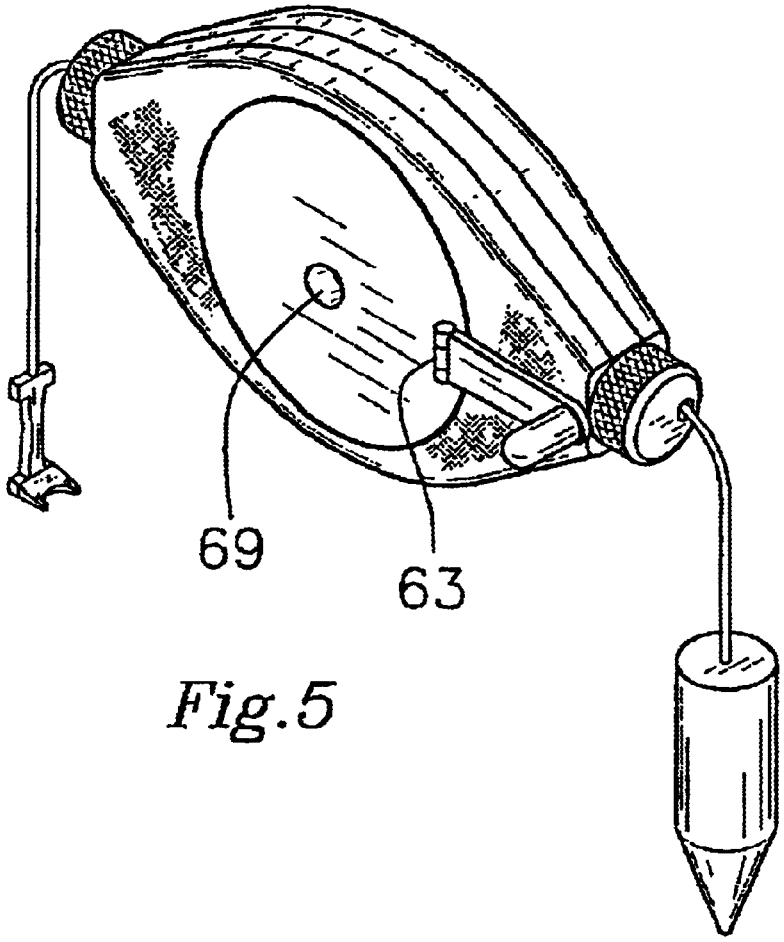
FIG. 5 is a schematic side perspective view of the optional embodiment of FIG. 4 shown in an assembled condition.
Figure 6:
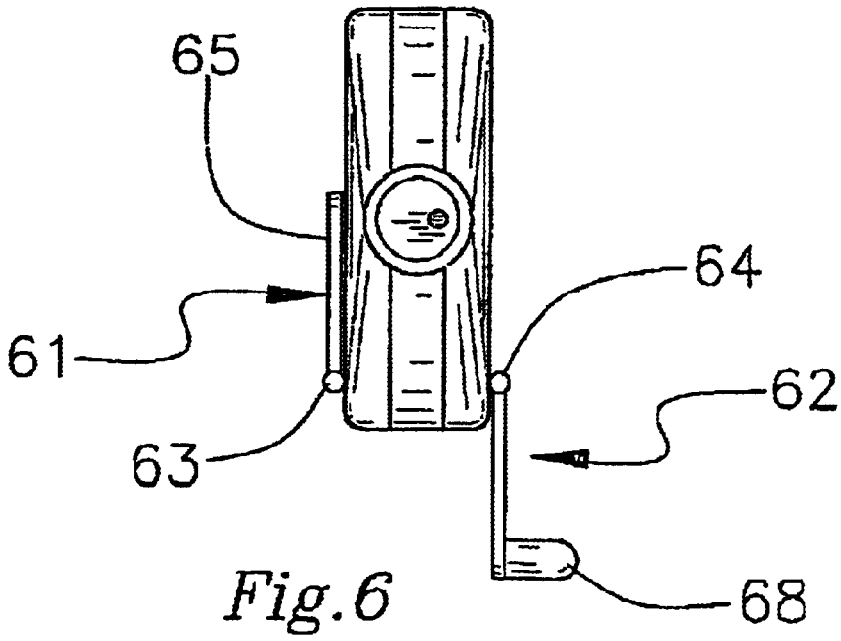
FIG. 6 is a schematic end view of the optional embodiment of FIG. 4.

An embodiment 50 of the invention having a number of optional features is shown in FIGS. 4 through 6. The optional divider panel 51 has a peripheral region 52 that is sandwiched between the side edges of the sections, and the peripheral region of the divider panel extends to the exterior of the housing.

Optionally, a pair of discs 53, 54 may be provided, with each of the discs being rotatably coupled to one of the spools. A pair of shafts 56 may also be provided, with each of the shafts having an end mounted on one of the discs and extending from the inner face of the disc. Each of the shafts 55, 56 extends through a central aperture 57, 58 of an adjacent one of the sidewalls. Each of the shafts has an inner end mounted to one of the spools in a manner preventing rotation of the spool relative to the shaft.

The sidewall of each of the sections of the optional embodiment has a recess 59 formed therein receiving a portion of one of the discs such that an outer face of the disc is substantially flush with an outer surface of the sidewall.

The eyelet 60 in the endcap is preferably offset from a central location on the endcap such that the eyelet is alignable with the opening into the compartment which is not blocked by the flange of the divider panel.

The optional embodiment has a pair of handles 61, 62, with each of the handles being mounted to one of the discs for permitting manual rotation of the disc. Each of the handles has a hinge 63, 64 coupled to an outer face of one of the discs. An arm portion 65, 66 of the handle is coupled to the hinge. A grasping portion 67, 68 of the handle is rotatably coupled to the arm portion. The hinge permits pivoting of the arm portion between a deployed position and a retracted position. The grasping portion is outwardly extended when the arm portion is in the deployed position. Each of the grasping portions is oriented generally perpendicular to the respective arm portion. Each of the discs has a central handle receiving aperture 69 extending into an outer face of the disc for selectively receiving the grasping portion when the arm portion is in the retracted position.

Figure 7:
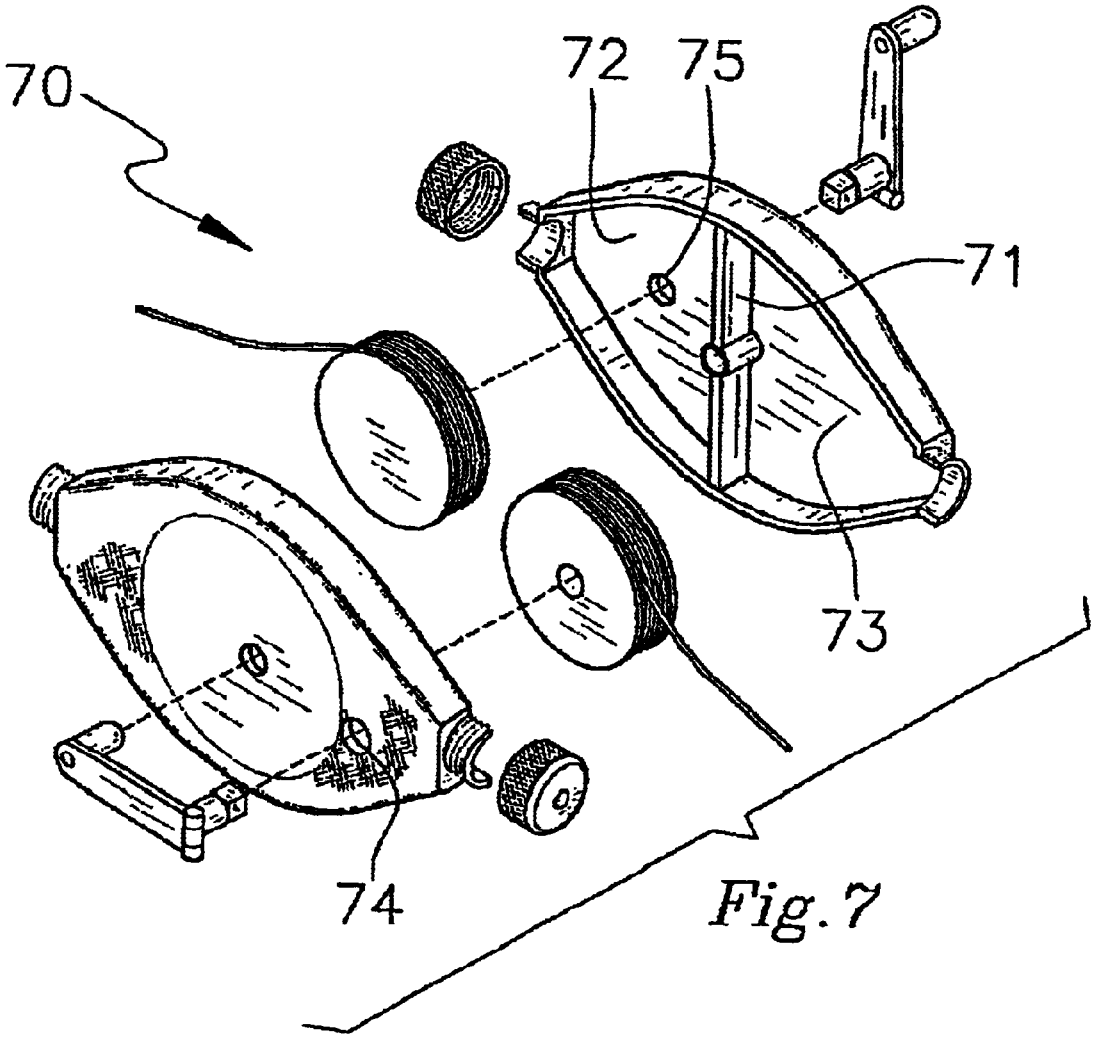
FIG. 7 is a schematic exploded view of an optional embodiment of the chalk line device according to the present invention.
Figure 8:
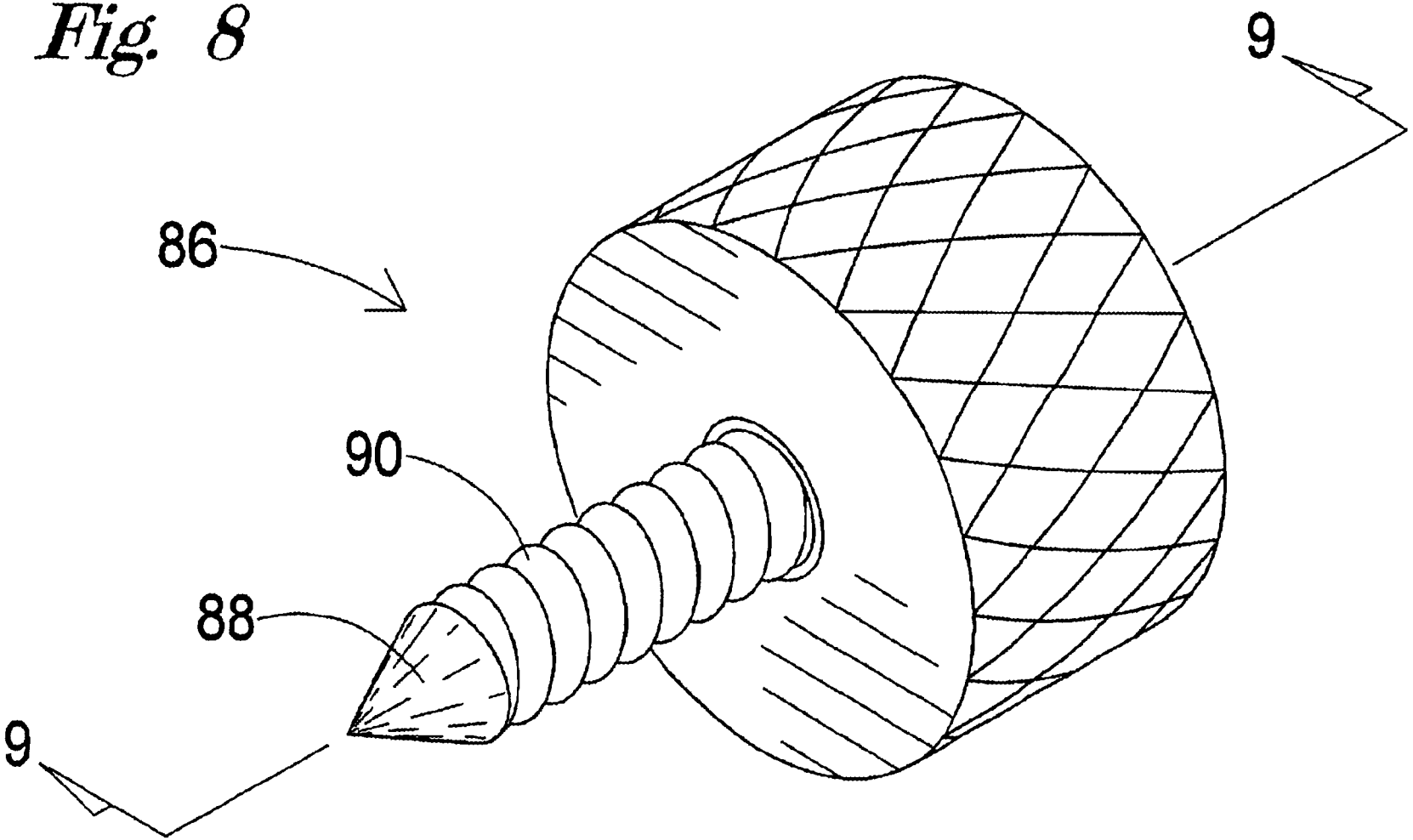
FIG. 8 is a schematic perspective view of an optional cap embodiment of the invention having a retractable pin mounted thereon.
Figure 9:
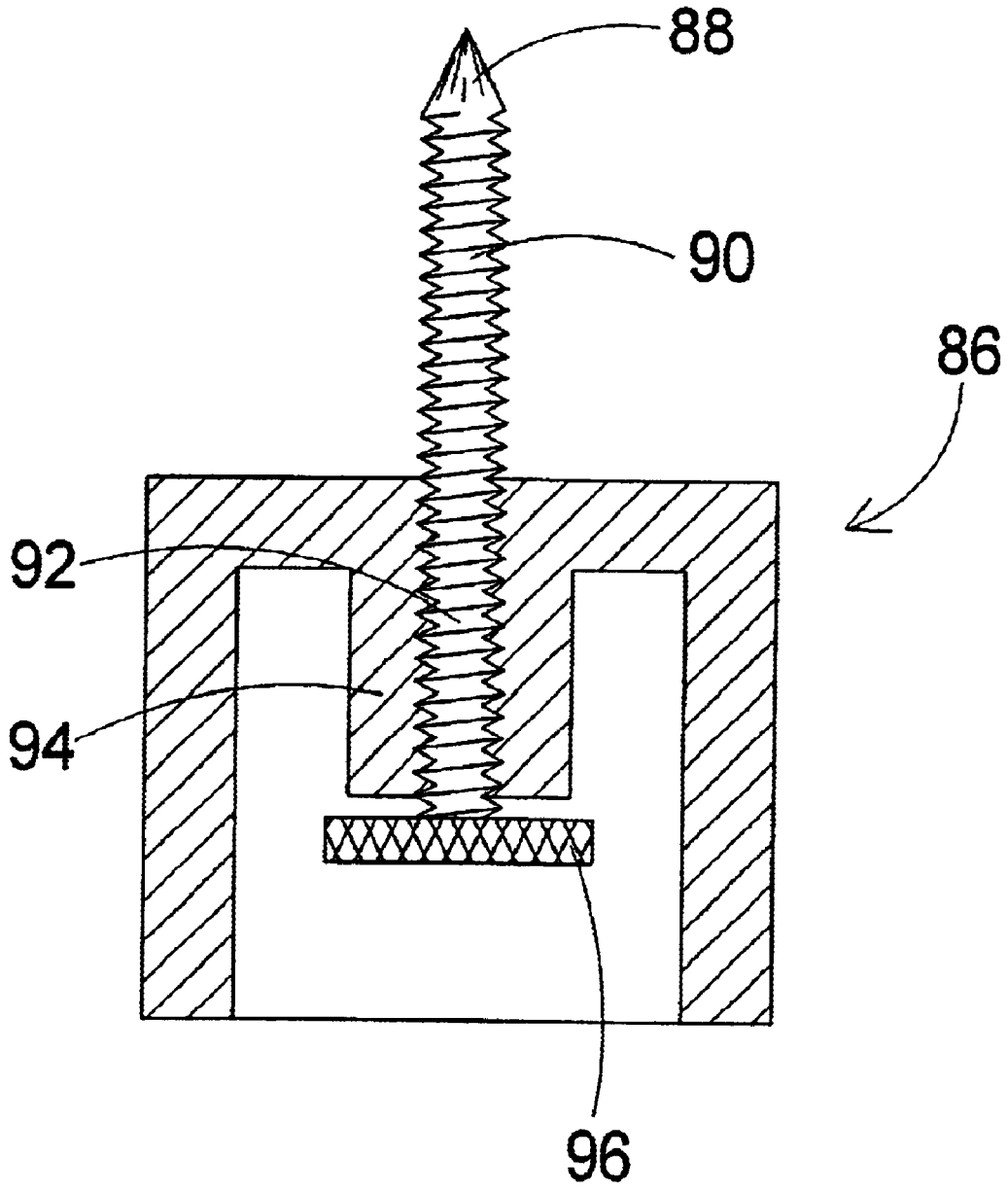
FIG. 9 is a schematic sectional view taken along line 9—9 of FIG. 8.
Figure 10:
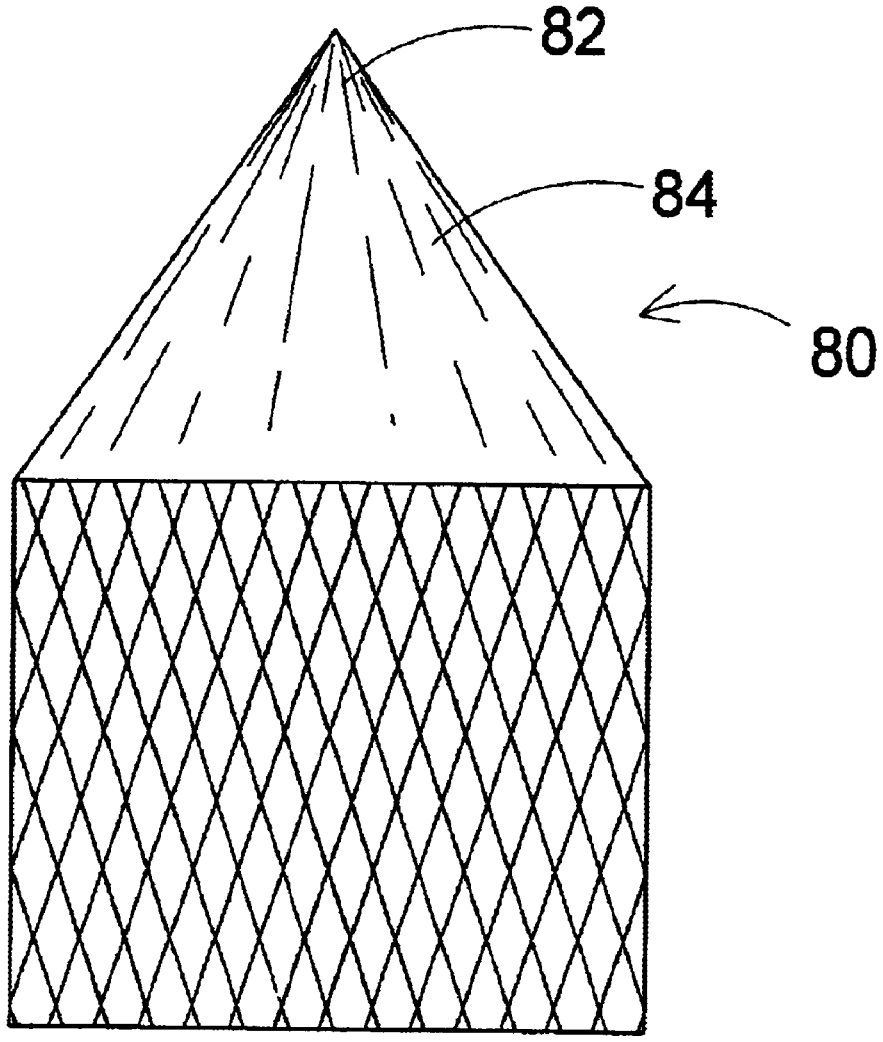
FIG. 10 is a schematic side view of an optional cap embodiment of the invention having a substantially conical portion.
Figure 11:
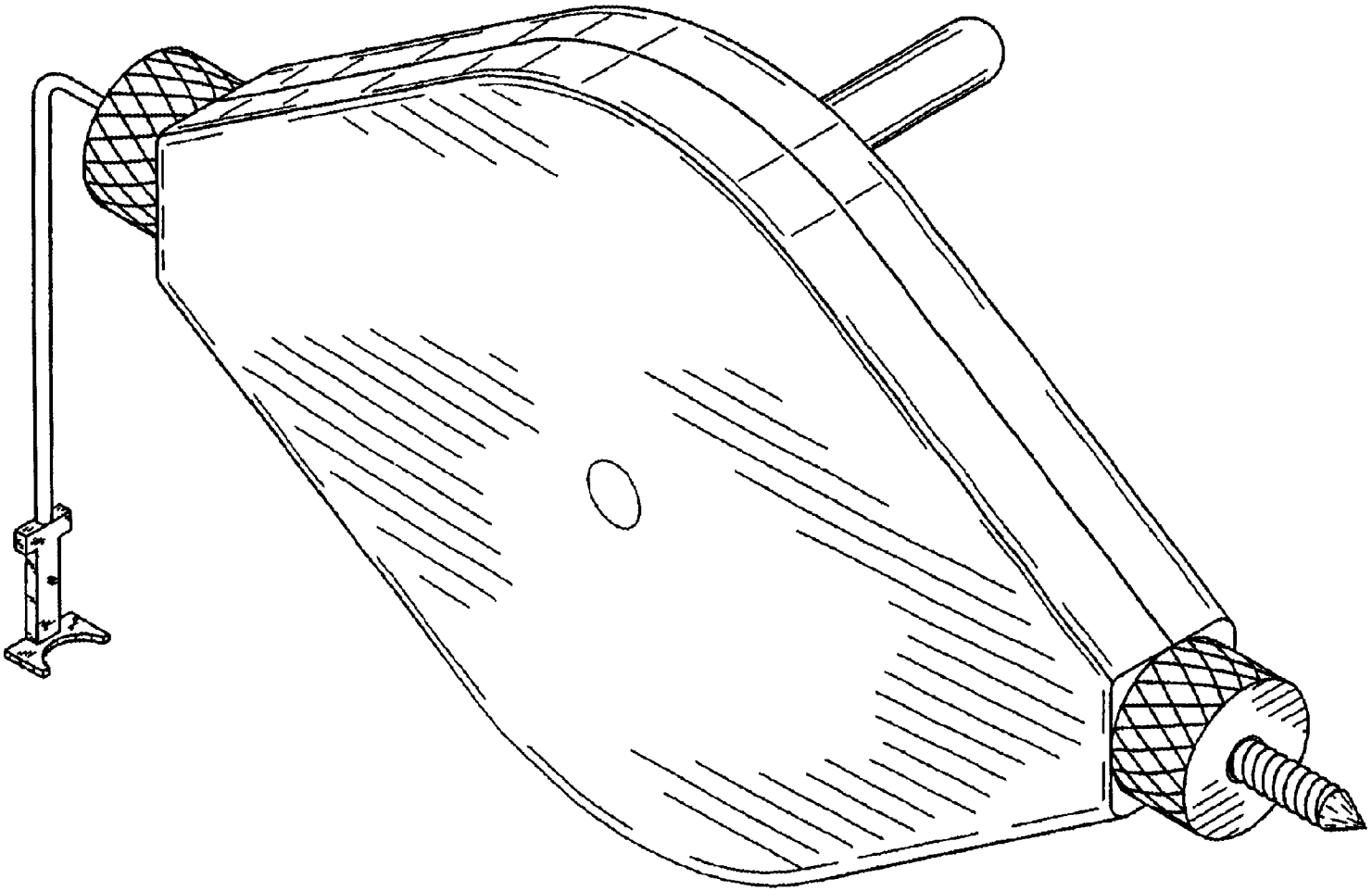
FIG. 11 is a schematic perspective view of a chalk line device having a single chalk line extending through one endcap and the retractable pin mounted on the other endcap.

Another optional embodiment 70 of the invention is shown in FIG. 7 of the drawings. The optional chalk line device includes a housing having a pair of separable sections and a pair of openings, and each of the sections has a sidewall, a pair of opposite ends, and a pair of side edges extending between the ends.

Significantly, each of the sections has a divider wall 71 mounted on the sidewall. The divider wall extends substantially perpendicularly to an axis extending between the opposite ends. The divider wall of a first one of the sidewalls is alignable with the divider wall of a second one of the sidewalls to define a pair of chambers 72, 73 between the sidewalls of the housing. Each of the chambers are located adjacent to and in communication with one of the openings of the housing.

Each of the sections of the housing has an aperture 74, 75 through the sidewall of the housing at a location that is offset from the center of the housing for receiving a shaft mounted on a handle.

An optional embodiment of the invention employs a cap 80 that has a pointed tip 82 formed thereon that may function as plumb bob tip so that the housing functions as a plumb bob. In embodiments employing the optional cap embodiment 80, typically only one cap 80 is mounted on the housing while a cap 24 with an eyelet 25 is mounted on the other end of the housing. One embodiment of the cap 80 has a substantially conical portion 84 on which the pointed tip 82 is formed (see FIG. 10). In another embodiment 86 of the cap, a pointed tip 88 is located on an end of a pin 90 that is mounted on the cap (see FIGS. 8, 9, and 10). Optionally, the pin 90 is selectively retractable into the cap 86 for periods of storage and is selectively extendable from the cap for periods of use. The pin 90 may have a body portion 92 with a section of the exterior surface having threads formed thereon. The pin 90 may be mounted in a sleeve 94 formed on the cap 86, and the sleeve may have an interior surface that has a complementary threaded interior surface that engages the exterior threading of the boy portion of the pin 90. The pin 90 may also have a stop flange 96 formed on an end of the pin opposite of the pointed tip 88. The stop flange 96 may be rotated by the finger of the user in a first direction to extend the pin 90 from the cap, and may be rotated in a second direction to retract the pin 90 into the sleeve of the cap. Thus, when the housing and cap 86 is to be used as a plumb bob, the cap may be removed from the housing and the pin rotated to extend a portion of the pin from the cap, and the cap is replaced on the housing. When use of the housing as a plumb bob is complete, the cap may be removed, the pin rotated to retract the pin into the sleeve, and the cap may then be replaced on the housing until the next use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk line device comprising:

a housing having a pair of first and second separable sections that define an interior for receiving a quantity of chalk, each of the sections having a sidewall and a perimeter wall extending inwardly from the sidewall toward the other of the sections;

a spool being rotatably mounted in the interior of the housing, the spool having a quantity of line wrapped therearound;

wherein the housing has a pair of openings located on substantially opposite locations of the housing, a first one of the openings being formed by a first protruding portion of each of the first and second sections of the housing, a second one of the openings being formed by a second protruding portion of each of the first and second sections of the housing;

a pair of caps removably mounted on the housing for selectively closing the openings, a first one of the caps engaging the first protruding portions of the first and second sections at the first opening and a second one of the caps engaging the second protruding portions of the first and second sections at the second opening;

wherein the caps releasably secure the first and second sections of the housing together such that mounting of the first and second caps on the housing holds the first and second sections together and removal of the caps from the housing releases the first and second sections from each other.

2. The device of claim 1 wherein each of the first and second protruding portions is semicircular, the first protruding portions of the first and second sections forming a first tubular structure with a substantially cylindrical exterior surface, the exterior surface of the first tubular structure having threads formed thereon, the first cap being threadable onto the first tubular structure to hold the first protruding portions together and thereby secure the first and second sections together, the second protruding portions of the first and second sections forming a second tubular structure with a substantially cylindrical exterior surface, the exterior surface of the second tubular structure having threads formed thereon, the second cap being threadable onto the second tubular structure to hold the second protruding portions together and thereby secure the first and second sections together.

3. The device of claim 1 wherein one of the caps has an eyelet for passing a portion of the line therethrough.

4. The device of claim 1 additionally comprising a handle being mounted to the spool and positioned outside the housing for rotating the spool.

5. The device of claim 1 additionally comprising a divider panel being positioned between the sections of the housing and separating the interior of the housing into a pair of compartments.

6. The device of claim 5 wherein the spool is mounted in a first one of the compartments, and additionally comprising a second spool being rotatably disposed in a second one of the compartments of the housing.

7. The device of claim 5 wherein the divider panel forms a seal with the sections of the housing for blocking chalk from moving between the compartments.

8. The device of claim 5 wherein the divider panel has a first flange extending from an end of the divider panel in a first direction for closing one of the openings off from a first one of the compartments, the divider panel having a second flange extending from another end of the divider panel in a second direction for closing another of the openings off from a second one of the compartments.

9. The device of claim 5 wherein the divider panel has a peripheral region sandwiched between the perimeter walls of the sections.

10. A chalk line device of comprising:

a housing having a pair of first and second separable sections that define an interior for receiving a quantity of chalk, each of the sections having a sidewall and a perimeter wall extending inwardly from the sidewall toward the other of the sections;

a spool being rotatable mounted in the interior of the housing, the Spool having a quantity of line wrapped therearound;

wherein the housing has a pair of openings located on substantially opposite locations on the housing, a first one of the openings being formed by a first protruding portion of each of the first and second sections of the housing, a second one of the openings being formed by a second protruding portion of each of the first and second sections of the housing;

a pair of caps removably mounted on the housing for selectively closing the openings, a first one of the caps engaging the first protruding portions of the first and second sections at the first openings and a second one of the caps engaging the second protruding portions of the first and second sections at the second opening;

wherein the caps releasably secure the first and second sections of the housing together such that mounting of the first and second caps on the housing holds the first and second sections together and removal of the caps from the housing releases the first and second sections from each other; and wherein a pointed tip is formed on one of the caps.

11. The device of claim 10 wherein the pointed tip is located on an end of a substantially conical surface.

12. The device of claim 10 wherein the pointed tip is located on an end of a pin mounted on the cap.

13. The device of claim 12 wherein the pin is selectively retractable into the cap for periods of storage and is selectively extendable from the cap for periods of use.

* * * * *